United States Patent [19]

Hedstrom et al.

[11] 4,171,854

[45] Oct. 23, 1979

[54] DOCUMENT HOLDER

[75] Inventors: Norman A. Hedstrom; Frederick J. Moriarty; Robert G. Bogren, all of Worcester, Mass.

[73] Assignee: Wright Line Inc., Worcester, Mass.

[21] Appl. No.: 894,705

[22] Filed: Apr. 10, 1978

[51] Int. Cl.[2] ..... A47B 63/00; B42F 13/06

[52] U.S. Cl. ..... 312/184; 312/188; 402/17

[58] Field of Search ..... 312/184, 183, 188; 402/4, 38, 17

[56] References Cited

U.S. PATENT DOCUMENTS

| | | | |
|---|---|---|---|
| 2,860,642 | 11/1958 | Marks et al. | 312/184 |
| 3,312,515 | 4/1967 | Barker | 312/184 |
| 3,628,877 | 12/1971 | Barnes, Jr. | 402/4 |
| 3,865,445 | 2/1975 | Dean et al. | 312/184 |
| 3,980,360 | 9/1976 | Wright et al. | 402/38 |
| 4,056,296 | 11/1977 | Hedstrom et al. | 312/184 |

FOREIGN PATENT DOCUMENTS

| | | | |
|---|---|---|---|
| 1940731 | 2/1971 | Fed. Rep. of Germany | 312/183 |
| 408858 | 9/1966 | Switzerland | 312/184 |
| 875777 | 8/1961 | United Kingdom | 312/184 |
| 977670 | 12/1964 | United Kingdom | 312/184 |

*Primary Examiner*—Victor N. Sakran
*Attorney, Agent, or Firm*—Milton E. Gilbert

[57] ABSTRACT

A novel loose-leaf holder is provided for binding documents such as multi-leaf computer printouts and mounting the same in a suspension-filing and/or storing system. The holder is of the type described in U.S. Pat. No. 4,056,296 and comprises a plastic body which is molded as an integral unit and comprises two side sections which are connected together by a hinge section so that they can be swung toward and away from one another. The improvement comprises document mounting pins carried by one side section and engageable by the other side section, one or more of the pins being adjustbly mounted on the one side and movable toward and away from the other pins. Manually releasable locking means are provided for locking the two side sections together so as to captivate documents which are mounted on the pins.

12 Claims, 12 Drawing Figures

20C
6
56
36
14A
12B
12A
14B
28B
28A
26
4B
34B
34A
4A
76A
76
76B
77
7
18A
18B
16A
16B
28A
28B
32A
32B
30A
30B
20A
20B
64B
64A
64C
74
72
70
68
62
60
58

DOCUMENT HOLDER

This invention relates to document holders and more particularly to devices for binding and filing documents and other sheet materials.

Holders for loose-leaf materials, and in particular document holders designed for binding and filing such materials as computer printouts in suspension filing systems are well known. For example, see U.S. Pat. No. 4,056,296 and the references cited therein. The document holder shown in U.S. Pat. No. 4,056,296, with respect to which the present invention is an improvement, comprises a plastic body, molded as an integral unit having two side sections which are connected together by a hinge section so that they can be swung toward and away from one another, and document mounting posts or pins integrally mounted to one side section and engageable by the other side section. Manually releasable locking means are provided for locking the two side sections together so as to captivate documents mounted on the pins.

Although the document holder of U.S. Pat. No. 4,056,296 has proven commercially successful, the fact that it employs pins which are fixed with respect to the two side sections as well as each other imposes limitations with respect to the types of materials which can be held by the holder. For example, holders suitable for binding computer printouts normally associated with computer printers found in the United States are unable to accommodate all of the numerous different sizes of printouts produced by European printers. As a consequence when using holders designed for one type of document with another, the latter may have to be stretched to fit from one fixed pin to another with, the possible result of the paper of the document tearing. Further, even when documents are easily mounted on the fixed pins, the dimension of the paper of the documents may vary due to moisture absorption, causing the documents to buckle, when mounted on the pins.

Accordingly, it is a primary object of the present invention to provide an improvement over the document holder of the type described in U.S. Pat. No. 4,056,296.

Another object of this invention is to provide a new plastic document holder which is designed to be used as a binder for loose-leaf sheet materials such as catalog and reference manual pages, ledger sheets, computer printouts, drawings, prints and the like.

Another specific object is to provide a device which is designed to be used as a multi-document carrier in a suspension filing system of the type comprising a single support hanger or two side support rails.

A further specific object of the present invention is to provide a novel document holder which can be made wholly of molded plastic, has only a few moving parts, can be adapted to accommodate documents of different sizes, offers the capability of attachment and detachment of documents, is sturdy, relatively light weight, and adapted for use in a suspension filing system, and can be made in different colors or provided with distinctive indicia to facilitate storage in readily indentifiable groups.

Yet another object of the present invention is to provide an improved document holder which comprises two or more mounting pins, at least one of the pins being adjustably mounted with respect to the others so as to accommodate various sized documents.

These and other objects of the invention are achieved by providing a document holder that comprises two opposed side sections which are connected to one another by an integral hinge so that they can be swung toward and away from one another, at least two document mounting pins for holding the documents and carried by one side section and engageable by the other side section, one or more of the pins being adjustably mounted on the one side section and movable relative to the other pins, and locking means for releasably locking the two side sections together whereby to captivate documents that are mounted on the binding posts. The two side sections are formed with hook means for mounting the holder to a suitable support hanger or the rails of a suspension filing system.

Other features and specific details of the invention are set forth in the following description which is to be considered together with the drawings wherein.

Figures 2, 3, 4:
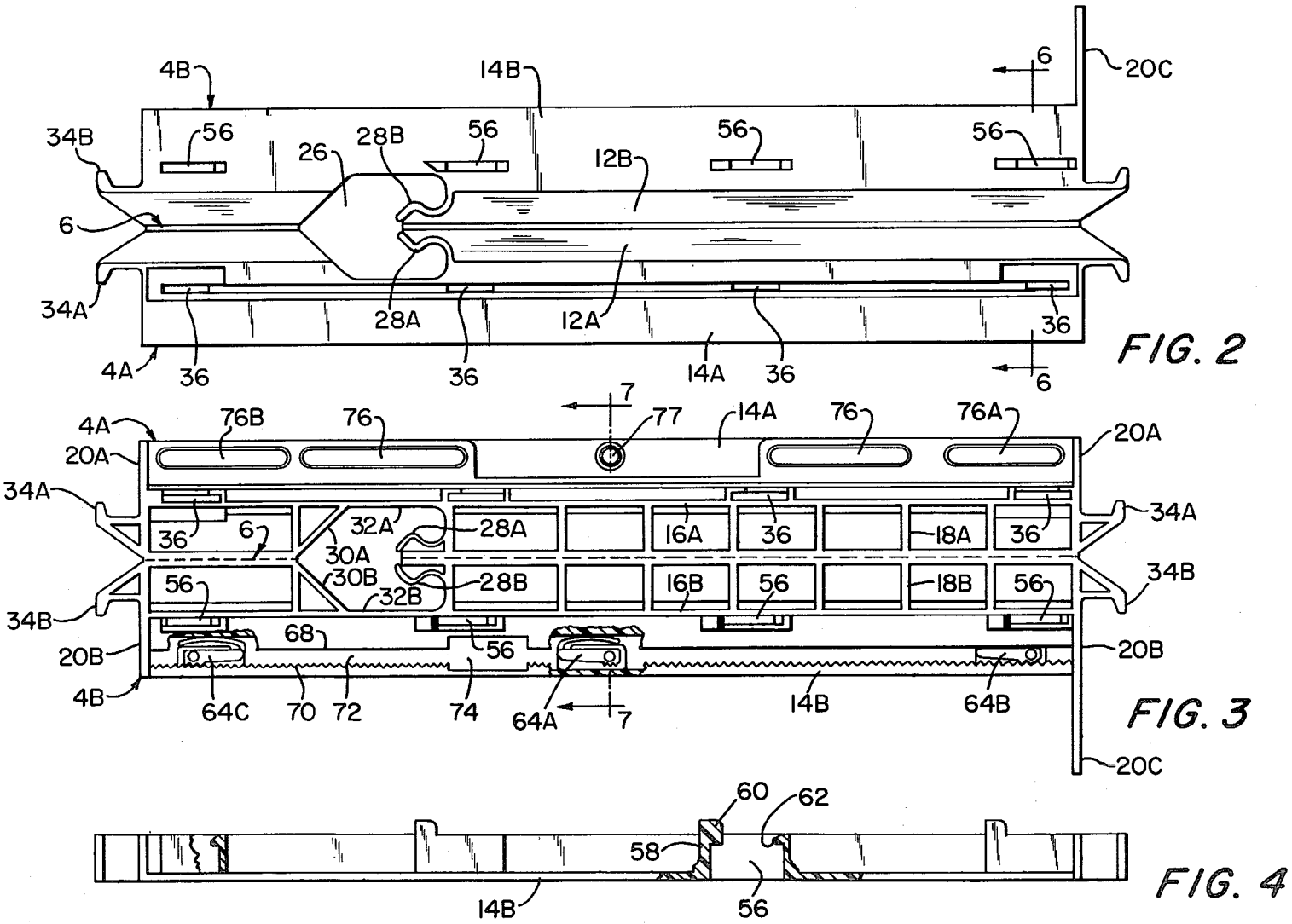
FIG. 2 is a plan view of the same holder in its fully open condition.
FIG. 3 is a bottom view of the fully open holder of FIG. 2 with portions cut away.
FIG. 4 is a side view of the holder as shown in FIG. 3, with a portion thereof shown in section.
Figure 5:
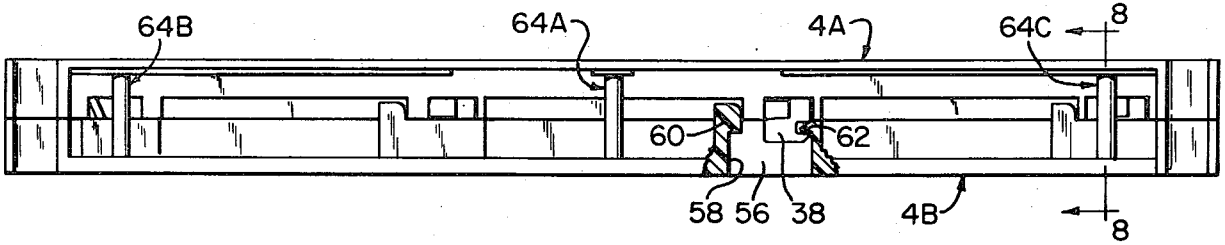
FIG. 5 is a bottom view, partly in section, of the holder in closed condition.
Figure 7:
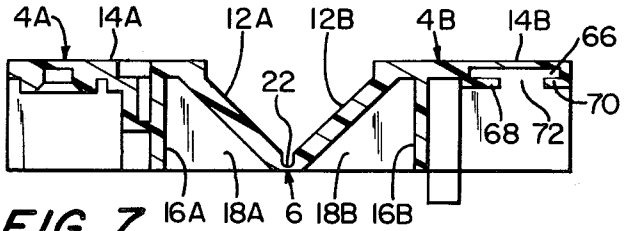
Figure 9:
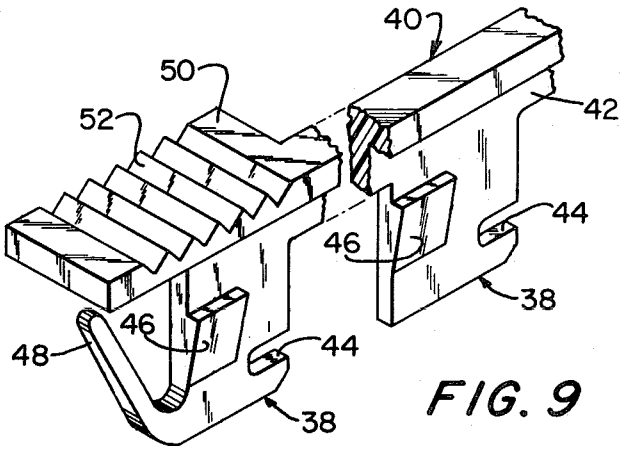
Figure 6:
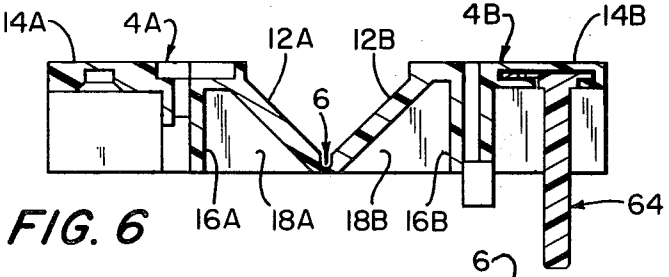
Figure 8:
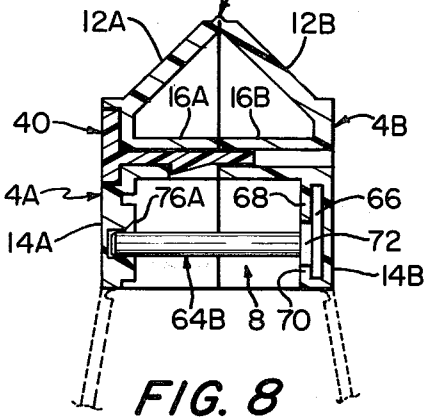
Figure 10:
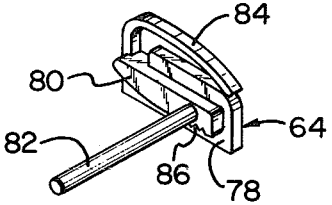
Figure 11:
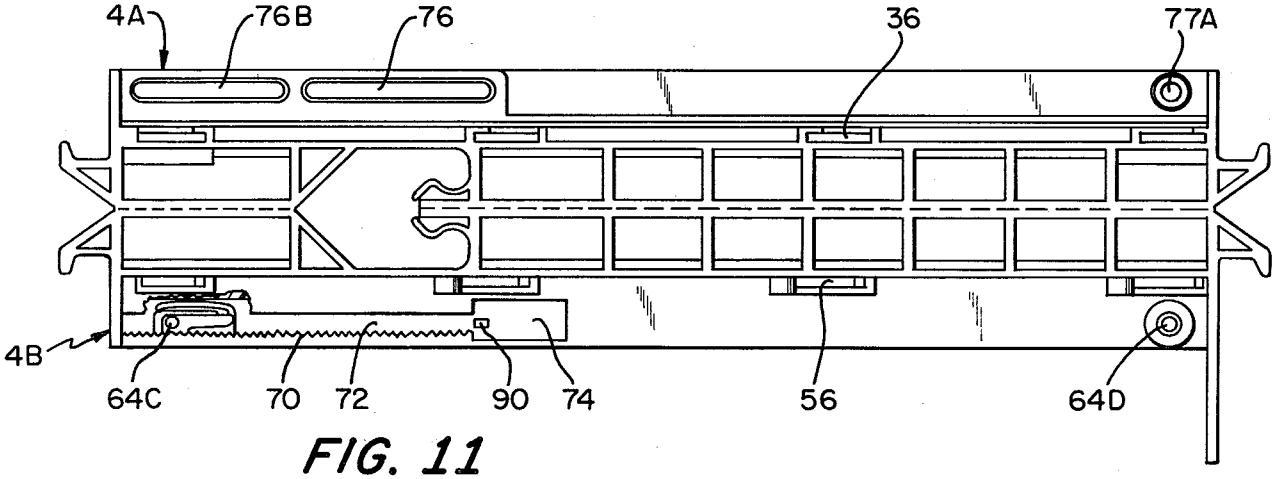
Figure 12:
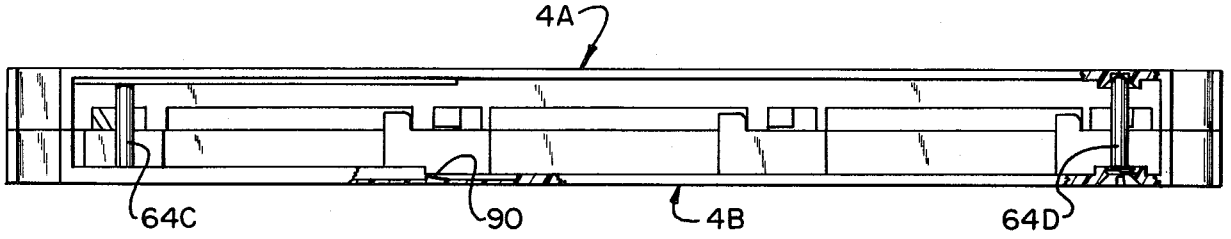

FIGS. 6 and 7 are enlarged cross-sectional views taken substantially along lines 6—6 and 7—7 of FIGS. 2 and 3, respectively;

FIG. 8 is an enlarged cross-sectional view taken substantially along line 8—8 of FIG. 5;

FIG. 9 is an enlarged and fragmentary perspective view of significant portions of the locking unit;

FIG. 10 is an enlarged perspective view of the improved mounting pin of the present invention;

FIG. 11 is a bottom view of the fully open holder of an alternative embodiment of the invention with portions cut away; and FIG. 12 is a bottom view, partly in section, of the holder of FIG. 11 in the closed position.

In the several views, like numbers are used to designate like parts, so as to facilitate a concise description of the invention.

Figure 1:
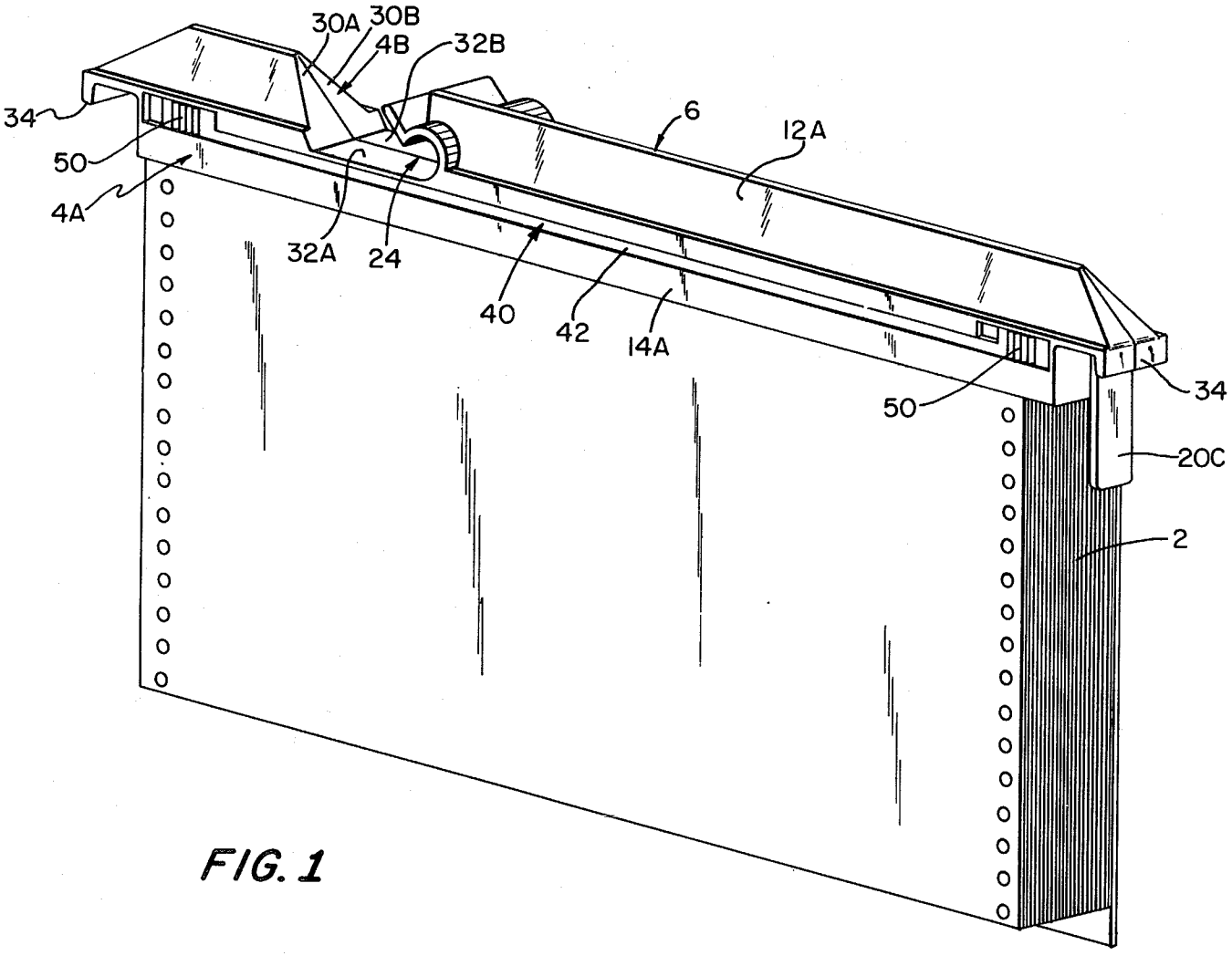
FIG. 1 is a perspective view of a document holder constituting an embodiment of the invention and a computer printout carried by the holder.

Referring now in greater detail to the drawings, there is shown in FIG. 1, a hanging type document holder which is adapted for use in a suspension filing system and designed to bind loose-leaf sheet materials, including a computer printout 2 of the type which is folded accordianwise into a plurality of folds or sheets. The holder comprises two opposite side sections 4A and 4B and a hinge section 6 which are made of a suitably flexible plastic and are molded as one piece. By way of example, but not limitation, the plastic may be polypropylene. When the holder is in its closed condition, i.e., with its side sections confronting and locked to one another as hereinafter described, it forms in cross-section a document receiving channel 8 (FIG. 8) with the channel being inverted when the holder is in use to store documents in a suspension filing system. More particularly, side sections 4A and 4B comprise side walls 12A and 12B each having one edge formed integral with hinge section 6, and side limbs 14A and 14B formed integral with the other edge of side walls 12A and 12B. As seen best in FIG. 6, side limbs 14A and 14B are disposed at like obtuse angles with respect to side walls 12A and 12B, respectively. Additionally (see FIGS. 3, 6 and 7) side sections 4A and 4B comprise longitudinally-extending partitions 16A and 16B, respectively, which extend at a right angle to the limbs and additional longitudinally spaced reinforcing struts 18A and 18B which are disposed at right angles to the limbs and partitions 16A and 16B. The opposite ends of side sections 4A and 4B are closed off by end walls 20A and 20B, respectively, that extend at right angles to limbs 14A and 14B. One of the end walls is preferably extended as shown, for example, at 20C for receiving identifying indicia, if desired.

Referring now to FIGS. 2, 3 and 6–8, the holder is molded in a substantially flat configuration, i.e., with the side sections separated and the limbs 14A and 14B being substantially co-planar, as shown in FIGS. 6 and 7. The hinge section 6 is formed so that in its as-molded condition (FIGS. 6 and 7) it is characterized by a thickness at its center less than that of side walls 12A and 12B, as for example, by providing groove 22 (see FIG. 7) where side walls 12A and 12B intersect, whereby it is capable of yielding to provide the requisite hinge action.

As a consequence of such a construction, the hinge section 6 is capable of being flexed and distended, by folding the hinge section 6 along the center groove 22 so as to permit the side sections 4A and 4B to be swung together from its open position into the closed position (FIGS. 1 and 8) and resilient enough to spring away from the closed position. When the holder is in its closed condition, the side walls 12A and 12B and hinge section 6 form an arch of generally triangular shape as seen in FIG. 8.

The upper portion of the holder defined by side walls 12A and 12B is characterized by a hook section, identified generally by numeral 24 (see FIG. 1). The latter is formed by molding the holder so that in its flat as-molded condition it has a generally heart-shaped hole 26 (FIGS. 2 and 3) with one-half of the hole being formed in side wall 12A and limb 14A and the other half being formed in side wall 12B and limb 14B, and hook-like projections 28A and 28B on side walls 12A and 12B. Hook section 24 confronts plate sections 30A and 32A on side section 4A and plate sections 30B and 32B on side section 4B. When the holder is in its closed position, the edge of plate sections 30A and 32A and projection 28A confront and engage the opposing edges of plate sections 30B and 32B and projection 28B, respectively, whereby projections 28A and 28B form a rounded hook and plate sections 30A, 30B and 32A, 32B form two angularly disposed surfaces that facilitate engaging the hook with a hanger or retaining member, not shown.

The side sections 4A and 4B also can be constructed so that, as seen in FIGS. 2 and 3, the opposite ends of side walls 12A and 12B and limbs 14A and 14B have integral hook-shaped extensions 34A and 34B. When the side sections 4A and 4B are swung together so that extensions 34A are brought into engagement with the corresponding extensions 34B, the extensions form hooks 34 at the opposite ends of the holder, whereby the holder may be supported by two rails of a conventional suspension filing system, e.g. like the holder shown in U.S. Pat. No. 3,628,877.

Locking means are provided for releasably locking the side sections 4A and 4B in the closed condition of FIGS. 1 and 8. For this purpose the section 4A is formed with a selected number e.g. four as shown, of apertures 36, spaced apart along its length and elongated lengthwise for accommodating a corresponding latching element 38 of multi-latch locking unit 40. The multi-latch locking unit 40, shown in FIGS. 1 and 9, comprises an elongated bar 42 integrally formed with the latching elements 38 and slidably mounted in an L-shaped groove formed in section 4A, so that slidably moving the bar between first and second positions moves latching elements 38 between locking and unlocking positions in the corresponding apertures 36. Each latching element 38 has (1) a hook 44 at one edge and sized so as to latch the sections 4A and 4B together when in the locking position and (2) a wedge shaped detent 46 projecting on one side for retaining the locking unit in operative disposition within side section 4A of the holder. Specifically, the sloping surfaces of detents 46 allows the latter to be forced through the apertures 36 and coact with section 4A to retain the locking unit in operative relation with side section 4B (see FIG. 8). Spring means in the form of a resilient finger 48 is also provided for biasing the locking unit to the locking position (toward the right in FIGS. 1 and 5). The finger 48 is integrally formed on at least one element 38 and located at an edge of that element opposite the edge at which hook 44 is located. The bar 42 is enlarged at both ends so as to provide buttons 50 which are serrated as shown at 52 to facilitate manual operation of the locking unit.

Referring to FIGS. 2–7 and 8, the other side section 4B is provided with means, in the form of catches (one for each latching element 38), adapted to be engaged by and connected to the locking unit 40 so as to maintain the holder in a closed condition. More specifically, the limb 14B of side section 4B is provided with four apertures 56 which are elongated lengthwise of the holder body and are located in alignment with corresponding ones of apertures 36 of side section 4A. Each aperture 56 is defined by projections 58, three of the four having extensions 60 at one end of the elongated aperture (those which receive the latching elements 38 without the finger 48) while all are provided with an inside lip 62 (FIGS. 4 and 5) that is shaped to engage the hook 44 of the corresponding latching element 38 when the latter extends into the aperture 56 and the locking unit 40 is moved to the locking position.

Thus, when closing the holder, side sections 4A and 4B are swung toward one another and the hook 44 of each latching element 38 is inserted through the respective aperture 56 and engages the corresponding lip 62. As the hook 44 engages the lip 62, the bar 42 together with the latching elements 38 is moved lengthwise against the bias of finger 48. As the hooks 44 clear the lips 62 the finger 48 biases the bar 42 as well as the latching elements 38 so that the hooks 44 interlock with the lips 62. To open the holder to remove or add documents, it is necessary to manually engage buttons 50 and thereby slide the unit 40 lengthwise in a direction (leftward in FIG. 1) against the bias of finger 48 to cause the hooks 44 to disengage the lips 62, whereupon the side sections 4A and 4B may be swung away from one another to the position shown in FIGS. 6 and 7. Extensions 60 of projections 58 serve as stops for the latching elements 38 and prevent the distortion and longitudinal displacement of section 4A relative to section 4B when the hooks 44 initially engage the lips 62.

To the extent described, the holder is identical to the holder described in U.S. Pat. No. 4,056,296.

The improvement provided by the present invention comprises adjustable document mounting pins carried by one of the side sections 4A or 4B and engageable by the other side section so as to accommodate various sized documents, i.e., one or more of the pins are adjustably mounted on the side section and movable toward or away from the other pins. More specifically, as shown in FIGS. 2, 3, 5, 6–8 and 10, in one embodiment the side section 4B is modified to accommodate one or more adjustable document mounting pins 64. In particular, an elongated slot 66 (FIGS. 6 and 7) is formed in the limb 14B substantially along the entire length of the holder between end walls 20B. The slot 66 is, in part, defined by opposed, i.e., upper and lower, lips 68 and 70 so as to define a narrow opening 72 to the slot. For reasons which will be more apparent hereinafter, one of the lips, the upper lip 68 being shown, is made wider than the other lip so that the longitudinal center line of opening 72 is parallel to but offset from the longitudinal center line of the slot 66. At least one enlarged opening 74, defined by the absence of lips 68 and 70, is provided to the slot 66 so as to permit the pins 64 to be inserted into the slot. One of the lips, in this case bottom lip 70, is provided with a serrated or ratchet edge (See FIG. 3).

The opposite side section 4A of the device of U.S. Pat. No. 4,056,296, is also modified so that, with the exception of the center hole 77, the through holes for receiving the fixedly mounted pins are replaced by elongated grooves 76 formed in the inner surface of limb 14A. Grooves 76 are mutually aligned lengthwise. As will be more evident hereinafter, the grooves 76 are made long enough and spaced with respect to one another according to the spacing dimension variations of the holes provided in the various computer printouts which the holder is adapted to hold.

The pins 64 (shown in FIGS. 3, 5, 6, 8 and 10) each include a base portion 78, a guide portion 80, a post 82 and a leaf spring member 84, all preferably integrally formed together of a tough, but resilient plastic such as nylon. The spring member 84 is attached at one of its ends at one side of the base portion 78 and extends in a curved manner about a part of the base portion so as to provide a space between at least the center portion of the spring member 84 and the base portion. The base portion 78 and spring member 84 are substantially coplanar and adapted to fit through opening 74 and slide slot 66 of the side section 4B of the holder. The guide portion 82 extending from the base portion 78 is elongated and sized so as to freely slide in the narrow opening 72 when the pin is properly oriented and the spring member 84 compresses as described hereinafter. The bottom edge of guide portion 80 just below post 82 is provided with one or more mating teeth 86 for engaging the ratchet edge extending along the lower lip 70 of the side section 4B of the holder. The post 82 extends in a substantially perpendicular direction from a point on the guide portion 80, which point is off center toward the side of the base portion 78 opposite to the side where spring member 84 is attached. The post 82 is dimensioned so that when the pin 64 of which it forms a part is properly attached to the side section 4B and the side sections 4A and 4B are folded to their closed position, the post 82 will extend into the opposite grooves 76 and will be restrained from movement in any direction, except the elongated direction of the groove.

In use, the base portion 78 of each pin is inserted through opening 74 with the spring member 84 oriented toward the center hinge 6 of the holder, and by applying gentle pressure on post 82 so as to cause spring member 84 to be compressed toward base portion 78, the guide portion 80 will freely slide in narrow opening 72 with teeth 86 free of the teeth on lower lip 70. In this regard it should be noted that the pin 64 cannot be inserted upside down with the teeth 86 facing the upper lip 68, due to the fact that the center line of opening 72 is offset from the center line of slot 66, and accordingly, in this situation the guide portion 80 would not align with the narrow opening 72.

It should be noted also that due to the assymmetrical arrangement of the pin, where adjustable pins are used at both ends, those inserted to the left of opening 74 as shown in FIG. 3 are actually made as a mirror image of those to the right of the opening 74 (the pin shown in FIG. 10 is one of the latter). By maintaining pressure on the leaf spring member 84 the pin can move longitudinally of the holder to a predetermined desired position depending on the documents to be bound by the holder. For example, as shown in FIGS. 3 and 5, three pins are utilized, with one pin 64A being positioned at the approximate center of the holder so that its post 82 of the pin will penetrate the aperture 78 when side sections 4A and 4B are folded in the closed position; the other two pins 64B and 64C are located at opposite ends of the holder and are positioned so as to engage the grooves 76A and 76B, respectively, when side sections 4A and 4B are moved to the closed position, as shown in FIG. 8. Once in position, the pressure on post 82 is withdrawn so that spring member 84 exerts sufficient pressure to lock the teeth 86 to the confronting teeth of the lower lip 70 of the side section 4A. The documents can then be mounted on posts 82, by inserting the posts through appropriate holes provided in the documents.

A preferred procedure for mounting documents, at least of the computer printout type, is to first mount the documents on the end pins 64B and 64C, slide the latter in the slot as previously described with the documents mounted thereon until the appropriate hole in the document is directly over the center pin 64A. The documents are then mounted on this center pin and the end pins adjusted until the documents essentially lie flat. In either procedure the side sections 4A and 4B are then folded to the closed position, making sure that the post 82 of the pins engage aperture 78 or grooves 76, and the locking unit 40 is utilized to lock the sections together. The holder can then be placed in a suitable storage unit by hanging it by its hook 28 or hooks 34. It will be appreciated that the weight of the documents will help to maintain the teeth 86 in locking engagement with the teeth on lower lip 70.

Although the holder has been described as utilizing all adjustable pins 64, it will be appreciated that one or more pins may be fixed as in the prior art device described in U.S. Pat. No. 4,056,296, with only one or less than all of the pins being of the adjustable kind. For example, as shown in FIGS. 11 and 12 where two pins are utilized, one pin, such as pin 64D can be fixed and pin 64C adjustable. Pin 64D engages hole 77A when the holder is closed (as in FIG. 12) in the same manner as described in U.S. Pat. No. 4,056,296. In this situation, the slot 66 need only extend from opening 74 to the end of section 4B receiving the pin with only the grooves 76 of section 4A opposite the slot being necessary. Also, although not shown, the holder may be modified so that one or more document-mounting pins are adjustably carried by link 14A and other like document-mounting pins are carried by link 14B.

A further modification shown in FIGS. 11 and 12 which could also be provided in the embodiment of FIGS. 1-10, is the incorporation of the ramp detent 90 in the opening 74 at the entrance to slot 66. Detent 90 is inclined from the opening toward the slot so that the base portion 78 of each pin placed in opening 74 will easily slide up the incline of detent 90 into slot 66. However, once in slot 66 the detent prevents the pin from accidentally sliding back out of the slot into the opening 74. Accordingly, the pin 64 can not be easily removed from the slot without forcing the base portion 78 over the detent 90.

It will be apparent that the present invention has an advantage over the holder described in U.S. Pat. No. 4,056,296 in providing adjustable mounting pins to accommodate various sized and types of documents.

What is claimed is:

1. In a holder for binding documents of the type comprising two side sections connected together by a hinge section so that said side sections can be swung toward and away from one another, at least two mounting pins secured to one of said side sections, and manually releasable locking means for locking said two side sections together so as to hold captive said documents on said pins between said sections, wherein:

said one side section includes an elongated slot and ratchet teeth extending in the elongated direction of said slot; and at least one of said mounting pins includes (1) a base portion adapted to slide lengthwise along said slot so that said one pin is movable toward and away from the other of said mounting pins and (2) mating teeth engageable with said ratchet teeth for locking said one pin in any one of a plurality of positions relative to the other of said pins.

2. A holder in accordance with claim 1, wherein said one side section further includes an opening for inserting said base portion of said at least one mounting pin into said elongated slot, and means for preventing said base portion for accidentally sliding out of said slot through said opening.

3. A holder according to claim 2, wherein said preventing means includes detent means positioned in said opening for allowing said base portion to easily slide into said slot and prevent said base portion from accidentally sliding from said slot through said opening.

4. A holder according to claim 3, where said detent means includes a ramp inclined from said opening toward said slot.

5. A holder in accordance with claim 1 wherein said at least one mounting pin includes a guide portion and said one side section includes an upper lip and a lower lip over at least a portion of the length of said slot, said lips coacting to define an opening to said slot and said guide portion being slidable along said opening.

6. A holder in accordance with claim 5 wherein one of said lips includes said ratchet teeth and said guide portion includes said mating teeth.

7. A holder in accordance with claim 6 wherein said at least one mounting pin further includes a post extending from said guide portion for receiving and supporting said documents.

8. A holder in accordance with claim 7 wherein said one lip is said lower lip so that weight on said post attributed to said documents insures that said mating teeth of said guide portion and ratchet teeth of said lower lip remain locked.

9. A holder in accordance with claim 7 wherein said at least one mounting pin further includes a leaf spring member for biasing said guide portion against said one lip.

10. A holder according to claim 9 wherein said spring member is insertable in said slot with said base portion.

11. A holder according to claim 9 wherein said base portion, guide portion, post and leaf spring member are integrally formed.

12. A holder according to claim 6, wherein the center line of said opening is offset from and parallel to the center line of said slot so that said base portion of said at least one mounting pin is insertable in said slot with the mating teeth of said guide portion facing the ratchet teeth of said one lip.

* * * * *

UNITED STATES PATENT AND TRADEMARK OFFICE

CERTIFICATE OF CORRECTION

PATENT NO. : 4,171,854

DATED : October 23, 1979

INVENTOR(S) : Norman A. Hedstrom et al

It is certified that error appears in the above-identified patent and that said Letters Patent are hereby corrected as shown below:

| | |
|---|---|
| Column 1, line 62: | Delete the word "indentifia-" and substitute therefor the word "identifia-" |
| Column 4, line 17: | Delete the word "allows" and substitute therefor the word "allow" |
| Column 7, line 41: | Delete the word "for" and substitute therefor the word "from" |

Signed and Sealed this

*Fifteenth* Day of *January 1980*

[SEAL]

*Attest:*

SIDNEY A. DIAMOND

*Attesting Officer*

*Commissioner of Patents and Trademarks*